US007833030B1

(12) United States Patent
Huang

(10) Patent No.: US 7,833,030 B1
(45) Date of Patent: Nov. 16, 2010

(54) SAFETY SHIELD FOR ELECTRICAL RECEPTACLES

(75) Inventor: Huadao Huang, Wenzhou (CN)

(73) Assignee: Huadao Huang (CN)

( * ) Notice: Subject to any disclaimer, the term of this patent is extended or adjusted under 35 U.S.C. 154(b) by 0 days.

(21) Appl. No.: 12/588,184

(22) Filed: Oct. 7, 2009

(30) Foreign Application Priority Data

Jul. 29, 2009 (CN) ..... 2009 2 0167808 U

(51) Int. Cl.
*H01R 13/44* (2006.01)

(52) U.S. Cl. ..... 439/137

(58) Field of Classification Search ..... 439/137, 439/145

See application file for complete search history.

(56) References Cited

U.S. PATENT DOCUMENTS

| | | | | |
|---|---|---|---|---|
| 4,379,607 | A | 4/1983 | Bowden, Jr. | |
| 5,006,075 | A * | 4/1991 | Bowden, Jr. | 439/137 |
| 5,915,981 | A * | 6/1999 | Mehta | 439/137 |
| 6,056,564 | A * | 5/2000 | Huang | 439/145 |
| 6,149,446 | A * | 11/2000 | Yu | 439/137 |
| 6,217,353 | B1 * | 4/2001 | Yu-Tse | 439/145 |
| 6,537,088 | B2 * | 3/2003 | Huang | 439/137 |
| 6,786,744 | B1 * | 9/2004 | Lee | 439/137 |
| 6,786,745 | B1 * | 9/2004 | Huang | 439/137 |
| 6,969,801 | B2 | 11/2005 | Radosavljevic et al. | |
| 6,998,945 | B2 * | 2/2006 | Huang et al. | 335/18 |
| 7,019,952 | B2 * | 3/2006 | Huang et al. | 361/42 |
| 7,179,992 | B1 * | 2/2007 | Packard et al. | 174/53 |
| 7,312,394 | B1 * | 12/2007 | Weeks et al. | 174/53 |
| 7,312,963 | B1 * | 12/2007 | Radosavljevic et al. | 361/42 |
| 7,355,117 | B2 * | 4/2008 | Castaldo et al. | 174/53 |
| 7,452,221 | B1 * | 11/2008 | Oddsen et al. | 439/137 |
| 7,510,412 | B1 * | 3/2009 | Valentin | 439/145 |
| 7,588,447 | B1 * | 9/2009 | Ni | 439/137 |
| 7,642,457 | B2 * | 1/2010 | Weeks et al. | 174/53 |
| 7,651,347 | B2 * | 1/2010 | Germain et al. | 439/137 |
| 2008/0156512 | A1 * | 7/2008 | Castaldo et al. | 174/53 |
| 2009/0035967 | A1 * | 2/2009 | Weeks et al. | 439/93 |
| 2009/0052120 | A1 * | 2/2009 | Weeks et al. | 361/601 |

* cited by examiner

*Primary Examiner*—T C Patel
*Assistant Examiner*—Vladimir Imas
(74) *Attorney, Agent, or Firm*—Andrews Kurth LLP

(57) ABSTRACT

The present invention provides a safety shield that can be fitted in an electrical receptacle, such as an outlet or a ground fault circuit interrupter, to cover the plug blade slots on the electrical receptacle. The safety shield comprises a base box containing a left sliding block, a right sliding block, small sliding block, and elastic components. If the plug blades are not inserted into the plug blade slots, the safety shield covers the plug blade slots to prevent unwanted objects from getting in touch with the electrical contacts within the plug blade slots causing electrical shock or damage to humans. If the plug blades are inserted into the plug blade slots, the elastic components within the base box are compressed to move the left sliding block outward to the left and the right sliding block outwards to the right so as to open the plug blade slots.

20 Claims, 3 Drawing Sheets

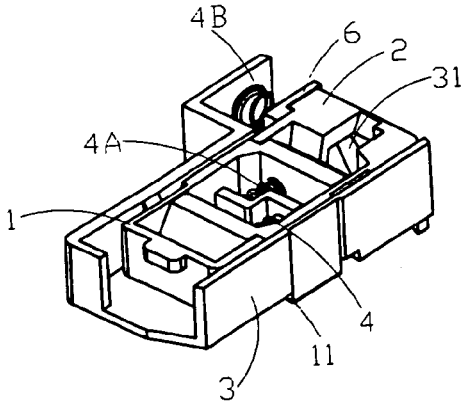
FIG. 2-A
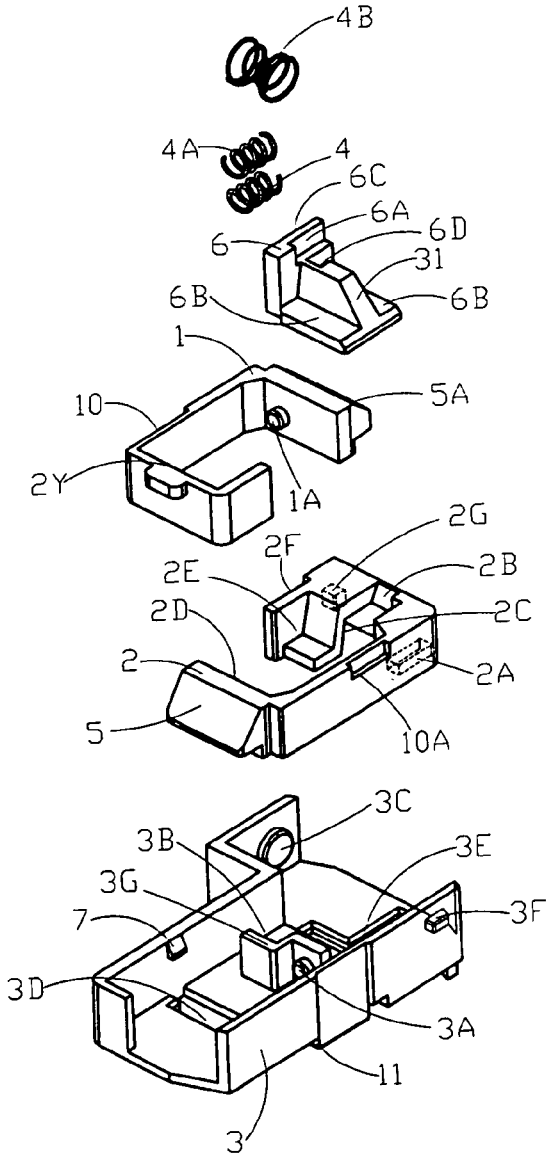
FIG. 2-B

SAFETY SHIELD FOR ELECTRICAL RECEPTACLES

RELATED APPLICATION

The present invention claims the priority of Chinese Patent Application No. 200920167808.3, filed on Jul. 29, 2009, which is herein incorporated by reference.

FIELD OF THE INVENTION

The present invention relates to a safety shield which can be installed in an electrical receptacle, such as an outlet and/or a ground fault circuit interrupter, to prevent unwanted objects from getting in touch with the electrical contacts within the plug blade slots causing electrical shock or damage to humans. The safety shield of the present invention meets the NEMA 5-20R standard.

BACKGROUND OF THE INVENTION

Safety is a priority in selecting household electric products, especially electrical receptacles, such as outlets, wall plugs, and ground fault circuit interrupters (GFCIs). Currently, the commonly used electrical receptacles are either 2-prong or 3-prong receptacles, each of which includes a housing body with conductive metal sheets installed inside the housing body. Three groups of conductive metal sheets, i.e., an output hot metal sheets, an output neutral metal sheets, and an optional grounding metal sheets, are placed under the two or three power plug slots, i.e., a hot plug blade slot, a neutral plug blade slot, and an optional grounding plug blade slot. The conductive metal sheets are respectively connected to the hot wire, neutral wire, and grounding wire inside the wall to supply power to the power plug slots of the electrical receptacles.

A young child may put his finger or a conductive object, such as a metal rod, inside the power plug slots out of curiosity. Since the conductive metal sheets inside the power plug slots of the electrical receptacles are exposed, the child may touch the conductive metal sheets inside the electrical receptacles, causing electrical shock injury or even death.

SUMMARY OF THE INVENTION

One embodiment of the present invention provides a safety shield which can be added to any electrical receptacles, such as electrical adaptors, electrical cords, outlet or wall plugs, and/or ground fault circuit interrupters, to prevent unwanted objects from entering into the plug blade slots to be in touch with the electrical contacts within the electrical receptacles, causing accidental electrical shock or damage to humans. The electrical receptacle has a face plate containing at least two plug blade slots to receive corresponding plug blades.

The safety shield of the present invention comprises a base box having at least two holes corresponding to the at least two plug blade slots on the face plate of the electrical receptacle. The base box contains (a) a left sliding block; (b) a right sliding block; (c) a small sliding block; and (4) elastic components. The left sliding block and the right sliding block are placed on the base box and are crisscrossed from each other. The small sliding block is connected to the right sliding block on the base box. The elastic components are placed between the left sliding block and the right sliding block, and between the small sliding block and a side wall of the base box. If the plug blades that are corresponding to the plug blade slots are not inserted into the plug blade slots, the left sliding block, the right sliding block, and the small sliding block form the safety shield to cover the plug blade slots so that no unwanted objects can be inserted into the plug blade slots. However, if the corresponding plug blades are inserted into the plug blade slots of the electrical receptacle, the elastic components are compressed to allow the left sliding block, the right sliding block, and the small sliding block to open the safety shield, thereby exposing the plug blade slots for the corresponding plug blades to be inserted into.

The at least two plug blade slots comprise at least an I-shape plug blade slot and a T-shape plug blade slot; in which the base box has an I-shape hole corresponding to the I-shape plug blade slot and a T-shape hole corresponding to the T-shape plug blade slot.

Alternatively, the at least two plug blade slots comprise two I-shape plug blade slots, in which the base box has two I-shape holes corresponding to the two I-shape plug blade slots.

Preferably, the left sliding block, the right sliding block, and the small sliding block have different structures.

The small sliding block has a longitudinal part which is positioned under one end of the right sliding block and on top of the T-shape hole of the base box. The small sliding block also has a transverse side wall which is positioned outside the right sliding block. The bottom of the small sliding block is extended outwards to be aligned with the safety shield formed by the right sliding block. The transverse side of the small sliding block has a groove corresponding to a protrusion on the side wall of the right sliding block. When the safety shield is assembled, the protrusion on the right sliding block fits into the groove on the small sliding block to allow the small sliding block to be positioned beneath the right sliding block and the right sliding block to be positioned at the inner side of the transverse side of the small sliding block.

The safety shield further comprises an auto-lock to prevent the safety shield from opening when the corresponding plug blades are not inserted into the at least two plug blade slots. The auto-lock is set in the right sliding block and positioned in a groove on the small sliding block. When the corresponding plug blades are inserted into the at least two plug blade slots, the auto-lock is unlocked.

The elastic components are preferably coil springs or leaf springs. They comprise a first spring positioned between the side wall of the base box and an outer transverse side of the small sliding block; and a pair of second springs positioned between the inner walls of the left sliding block and the right sliding block.

The first spring is secured by a first positional block on the base box. The second pair of springs is secured by a second positional block in a zigzag shape on the base box. The second pair of springs is positioned in the center of the base box between the inner sides of both the left sliding block and the right sliding block, and is parallel to and misaligned with each other. When the corresponding plug blades are inserted into the at least two plug blade slots on the electrical receptacle, the second pair of springs is simultaneously compressed toward each other so as to move the left sliding block outward toward left and the right sliding block outward toward right to expose the two holes corresponding to the at least two plug blade slots on said base box.

Another embodiment of the present invention provides an electrical receptacle comprising (a) a housing containing a face plate which has at least two plug blade slots to receive at least two corresponding plug blades; (b) a plurality of electrical contacts disposed in the housing; wherein one end of the plurality of electrical contacts is coupled to a power input source and the other end of the plurality of electrical contacts is exposed to the at least two plug blade slots; the plurality of electrical contacts is capable of mating with the plug blades; and (c) a safety shield positioned underneath the plug blade slots to cover the plug blade slots when the corresponding plug blades are not inserted into the plug blade slots.

The safety shield comprises a base box having at least two holes corresponding to the two plug blade slots of the electrical receptacle. The base box contains (a) a left sliding block; (b) a right sliding block; (c) a small sliding block; and (d) elastic components. The left sliding block and the right sliding block are crisscrossed from each other on the base box. The small sliding block is connected to the right sliding block on said base box. The elastic components are placed between the left sliding block and the right sliding block, and between the small sliding block and the side wall of the base box. If no corresponding plug blades is inserted into the plug blade slots of the electrical receptacle, the left sliding block, the right sliding block, and the small sliding block form the safety shield to cover the plug blade slots. If the corresponding plug blades are inserted into the plug blade slots of the electrical receptacle, the elastic components are compressed to allow the left sliding block, the right sliding block, and the small sliding block to open the safety shield, thereby exposing the plug blade slots.

The electrical receptacle is preferably a power adaptor, a power cord, an outlet, or a ground fault circuit interrupter.

The housing of the electrical receptacle can comprise a plurality of the base boxes.

The elastic components comprises a pair of springs positioned in a center of the base box secured by a positional block on the base box. The pair of springs is parallel to and misaligned with each other. When the corresponding plug blades are inserted into the plug blade slots, the pair of springs is compressed toward each other, so as to push the left sliding block to move to left and the right sliding block to move to right, thereby exposing the two holes on the base box which correspond to the at least two plug blade slots on the housing of the electrical receptacle.

BRIEF DESCRIPTION OF THE DRAWINGS

FIG. 2-1 is the structure of an assembled base box.

FIG. 2-2 is the detailed structural schematic of the components which form the safety shield, which, from top to bottom, contains the elastic components 4, 4A, 4B; the small sliding block 6; the left sliding block 1; the right sliding block 2; and the base box 3.

DETAILED DESCRIPTION OF PREFERRED EMBODIMENTS

The present invention provides a safety shield which can be installed in any electrical receptacles, including without limitation, a power cord, a power adaptor, an outlet or wall plug, and a ground fault circuit interrupter.

The following experimental designs and result are illustrative, but not limiting the scope of the present invention. Reasonable variations, such as those occur to reasonable artisan, can be made herein without departing from the scope of the present invention. Also, in describing the invention, specific terminology is employed for the sake of clarity. However, the invention is not intended to be limited to the specific terminology so selected. It is to be understood that each specific element includes all technical equivalents which operate in a similar manner to accomplish a similar purpose.

Figure 1:
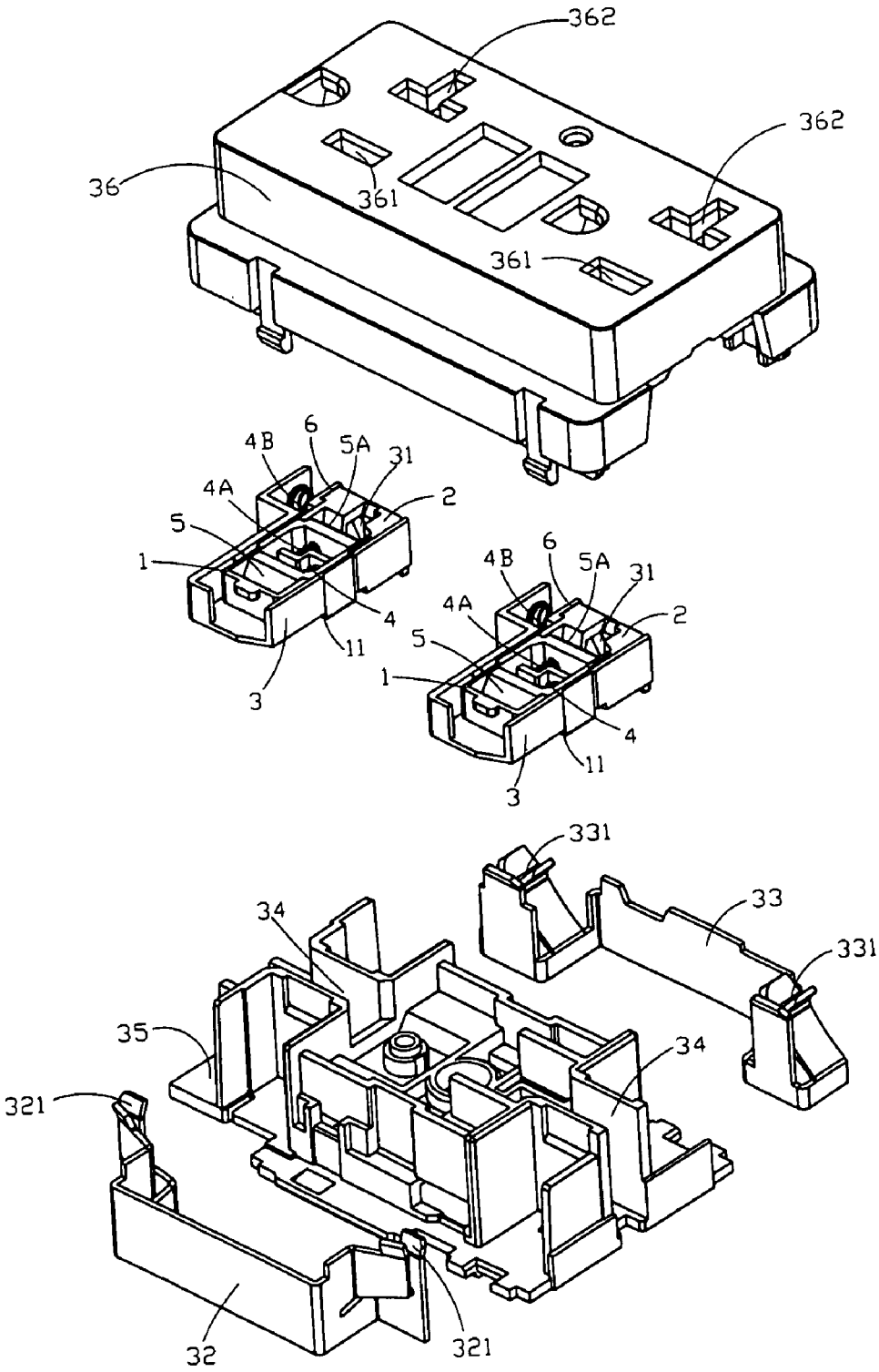
FIG. 1 is an exploded view of the structural schematic of an exemplary electrical receptacle (i.e., a ground fault circuit interrupter) containing a safety shield. The structure of a face plate of the electrical receptacle is shown in the top composite. Two assembled base boxes, each containing a left sliding block 1, a right sliding block 2, a small sliding block 6, and elastic components 4, 4A and 4B, are shown in the middle composite. The structure of the mid-section platform of the electrical receptacle is shown at the bottom. The left sliding block 1, the right sliding block 2, and the small sliding block 6 form the structure of the safety shield of the present invention.

As shown in the top composite drawing of FIG. 1, the exemplary electrical receptacle is a ground fault circuit interrupter (GFCI). It has a face plate 36 containing a pair of hot plug blade slots 361 and a pair of neutral plug blade slots 362 to receive power plugs from any office or household appliances. Also, as shown in the bottom composite drawing of FIG. 1, which illustrates the components of a mid-section of the GFCI, a hot output electrical conductor 32 and a neutral output electrical conductor 33 are shown in the left and right side of the bottom composite drawing. These two output electrical conductors 32, 33 are capable of electrically coupled to the hot and neutral power input sources (not shown) respectively to be electrically conductive. The two ends of the hot output electrical conductor 32 are extended upward to form a pair of hot gripping wing pieces 321, which become the terminals of the hot user accessible output ends and protruded under the pair of hot plug blade slots 361. The two ends of the neutral output electrical conductor 33 are extended upward to form a pair of neutral griping wing pieces 331, which become the terminals of the neutral user accessible output ends and protruded under the pair of neutral plug blade slots 362.

As shown in the middle composite of FIG. 1, a safety shield can be installed between one hot plug blade slot 361 and one neutral plug blade slot 362 on the face plate and the corresponding hot gripping wing piece 321, and the corresponding neutral gripping wing piece 331 on the mid-section of the electrical receptacle.

The safety shield of the present invention is further described in FIGS. 2-1 and 2-2. As shown in FIGS. 2-1, the safety shield is made of three sliding blocks, which are: left sliding block 1, right sliding block 2, and small sliding block 6. These three sliding blocks are contained in a base box 3. Also, as shown in the bottom composite of FIGS. 2-2, the base box 3 is a rectangular box with an rectangular extension at the upper right end, which is used for holding small sliding block 6. As shown in FIGS. 2-1 and 2-2, base box 3 also contains elastic components 4, 4A and 4B. The left sliding block 1 is crisscrossed with right sliding block 2, both sitting on top of base box 3 and capable of sliding along the surface of base box 3. The right sliding block 2 and the small sliding block 6 are combined together and held in base box 3. A pair of elastic components 4, 4A are placed between left sliding block 1, and right sliding block 2. Separately, an elastic component 4B is placed between a side wall of base box 3 and an outer side of the transverse wall of small sliding block 6. The elastic components 4, 4A and 4B, are preferably springs, such as coil springs or leaf springs, and most preferably coil springs. Also, preferably, elastic component 4B is larger and has more strength than elastic components 4, 4A. In addition, the pair of elastic components 4, 4A is identical in size and shape.

The safety shield of the present invention is suitable to be installed in an electrical receptacle having either identical I-shape of plug blade slots 361 or an I-shape plug blade slot 361 and an T-shape plug blade slot 362, as used in 20 Amperes devices. In either structure, base box 3 of the safety shield contains an I-shape hole 3D and a T-shape hole 3E corresponding to the I-shape plug blade slot 361 and the T-shape plug blade slot 362 (in the case where the electrical receptacle contains two identical I-shape plug blade slots, the tope "I" portion of the T-shape hole on base box 3 corresponds to the I-shape plug blade slot).

Figure 4:
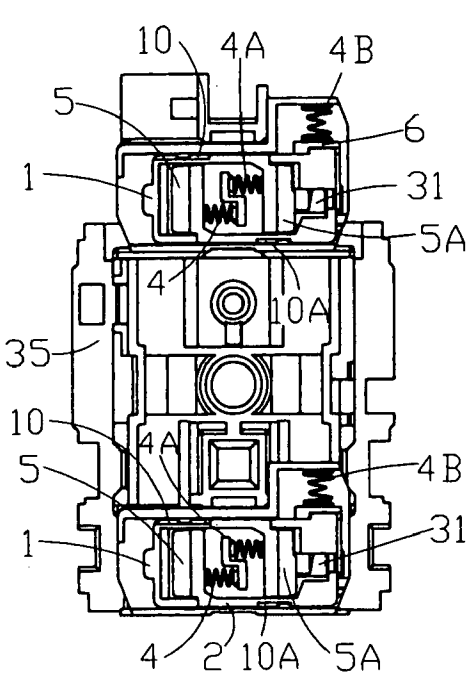
FIG. 4 is a top view of a pair of base boxes in relation to other components in an exemplary electrical receptacle where the face plate of the electrical receptacle has been removed. The base boxes are covered by the left sliding block 1, the right sliding block 2, the small sliding block 6, and elastic components 4, 4A and 4B. Shown in this Figure is a condition when the safety shield is in a closed position, as indicated by the relax positions of the elastic components 4, 4A and 4B. Under this condition, the gripping wing pieces 321, 331 are covered by the safety shield.
Figure 3:
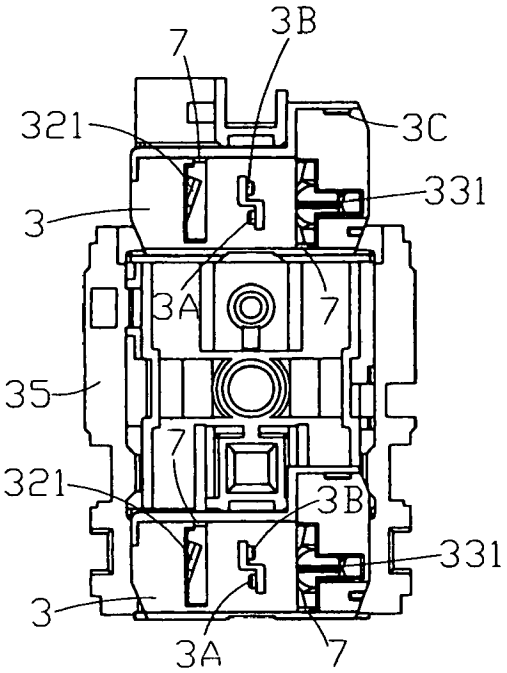
FIG. 3 is a top view of a pair of base boxes in relation to other components in an exemplary electrical receptacle. The electrical receptacle is illustrated without the face plate. The base boxes are drawn without the inclusion of the left sliding block 1, the right sliding block 2, the small sliding block 6, and the elastic components 4, 4A and 4B, so that the gripping wing pieces 321, 331 (i.e., the electrical contacts at one end of the hot output conductor 32 and one end of the neutral output conductor 33 protruding to the plug blade slots) can be seen from the two holes on the base boxes. The holes on the base boxes correspond to the plug blade slots on the face plate.

As illustrated in FIGS. 2-2 and 3, there is positional block 3G erected in the central portion of the top surface of base box 3 for positioning elastic components 4, 4A in base box 3. Positional block 3G is in a zigzag form with side walls facing opposite direction. There are two positional bumps 3A, 3B, one on each side of the side walls for securing elastic components 4, 4A in base box 3. As illustrated in FIG. 4, elastic components 4, 4A are parallel to and misaligned with each other, and facing opposite direction. Also, as illustrated in the bottom composite of FIGS. 2-2, elastic component 4B is securely positioned by positional bump 3C on the side wall of the upper right corner of base box 3.

To assemble the safety shield, left sliding block 1 and right sliding block 2 are first placed with each other in a crisscrossed position. After left sliding block 1 and right sliding block 2 are assembled, small sliding block 6 is added to right sliding block 2, and placed in base box 3, followed by adding elastic components 4, 4A and 4B to the correct position in base box 3 in relation to left sliding block 1, right sliding block 2 and small sliding block 6. Left sliding block 1, right sliding block 2 and small sliding block 6 are capable of gliding along the surface of base box 3, to control the exposing or covering of the I-shape hole 3D and T-shape hole 3E on the surface of base box 3.

The left sliding block 1 is positioned at the top surface of base box 3. The bottom of left sliding block 1 is hollow. As shown in FIGS. 1, and 2-2, left sliding block 1 has a slope 5A at the far right end which, together with the slope 31 of small sliding block 6, jointly covers the T-shape hole 3E of base box 3. When a pair of plug blades from a suitable power plug is inserted into the corresponding plug blade slots, the slope 5A of left sliding block 1 moves to the left and the slope 31 of small sliding block 6 move to the right at the same time to expose the T-shape hole 3E on base box 3.

The right sliding block 2 is positioned on the top of base box 3 and its bottom is hollow. As shown in FIGS. 1 and 2-2, the right sliding block 2 has a slope 5 which is located at the far left end of right sliding block 2 at the opposite side of the slope 5A of left sliding block 1. The slope 5 of right sliding block 2 covers the I-shape hole 3D on base box 3. When a pair of plug blades from a suitable power plug is inserted into the corresponding plug blade slots, the slope 5 of right sliding block 2 moves to the right to expose the I-shape hole 3D on base box 3. Groove 2B, which facilitates the insertion of the T-shape plug blade, is set up at the other end of the right sliding block 2 (FIGS. 2-2).

As shown in FIGS. 2-2, small sliding block 6 has a longitudinal part that is positioned below right sliding block 2 and on top of T-shape hole 3E at the surface of base box 3. The transverse sidewall 6C of small sliding block 2 is positioned outside of right sliding block 2. The small sliding block 6 also has a slope 31 which is parallel to the I-shape hole 3D. The left and right sides of the bottom of small sliding block 6 extend outwards to form a shield 6B. Also, as shown in FIGS. 2-2, there is a groove 6A on the transverse sidewall 6C of small sliding block 6, which matches with a protrusion 2F on the side wall of right sliding block 2. As shown in FIGS. 2-1, after left sliding block 1 and right sliding block 2 are placed in crisscrossed position, the longitudinal part of small sliding block 6 is inserted into the lower part of right sliding block 2 to position the right sliding block 2 at the inner side of the transverse sidewall of small sliding block 6.

As shown in FIGS. 2-2, the safety shield of the present invention contains an auto-lock 2G. The auto-lock 2G is set in right sliding block 2 and positioned in groove 6D of small sliding block 6. If no plug blades from the suitable power plug is inserted into the electrical receptacle, right sliding block 2 and small sliding block 6 is locked automatically, and the safety shield is up to prevent foreign objects from inserting into the plug blade slots. That is because when the suitable plug blades are not inserted into the plug blade slots, the slope 5A of left sliding block 1 and the slope 31 of small sliding block 6 works together to cover the T-shape holes 3E on the base box 3; and the slope 5 of right sliding block 2 covers the I-shape hole 3D on the base box 3. However, when the suitable plug blades are inserted into the plug blade slots, auto-lock 2G on right sliding block 2 and small sliding block 6 unlocks itself, so as to allow left sliding block 1, the right sliding block 2 and the small sliding block 6 to move to expose the I-shape hole 3D and T-shape hole 3E on base box 3.

As shown in FIGS. 2-1, after left sliding block 1, right sliding block 2 and small sliding block 6 are assembled together and held in base box 3, coil spring 4A is placed between the inner wall of left sliding block 1 and positional block 3G in the center of base box 3; coil spring 4 is placed between inner wall of right sliding block 2 and positional block 3G in the middle of base box 3; and coil spring 4B is placed between small sliding block 6 and the side wall of base box 3.

As shown in FIGS. 2-2, after left sliding block 1, right sliding block 2 and small sliding block 6 are assembled together, protrusion 7 on the side wall of base box 3 matches with groove 10 on the side wall of left sliding block 1 to be fixedly secured in base box 3. Similarly, protrusion 7 on the side wall in base box 3 matches with groove 10A on the side wall of right sliding block 2 to be fixedly secured in base box 3. In order to prevent left sliding block 1 and right sliding block 2 from sliding out of base box 3, a bump 3F is set up on base box 3, which matches with groove 2A of right sliding block 2.

As shown in FIGS. 1, 2-1, and 2-2, the safety shield fully assembled in base box 2 is placed between face plate 36 (FIG. 1, top composite) and mid-section support (FIG. 3, bottom composite) 35 of the electrical receptacle. When a power plug is forcibly inserted into the plug blade slots 361, 362, the T-shape plug blade of the power plug is in touch with the slope 5A of left sliding block 1 and the slope 31 of small sliding block 6; the I-shape plug blade of the power plug is in touch with the slope 5 of right sliding block 2. When the power plug is pushed downward more forcibly, the plug blades press on the slopes 5, 5A, 31 to make auto-lock 2G in right sliding block 2 to be pulled out of groove 6D in small sliding block 6, so as to unlock 2G and allow left sliding block 1 to glide to the left, right sliding block 2 and small sliding block 6 to glide to the right, to expose the T-shape hole 3E and I-shape hole 3D on base box 3. At this time, the plug blades are inserted into the gripping wing pieces 321, 331 below base box 3 to be in connect with the power output conductors 32, 33.

Figure 5:
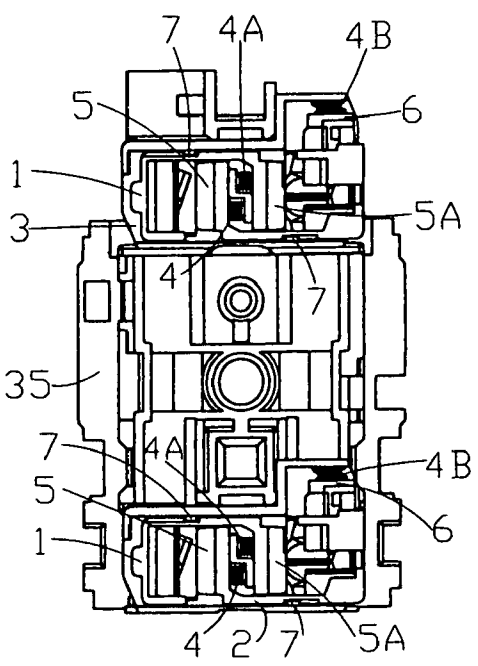
FIG. 5 is a top view of a pair of base boxes in relation to other components in an exemplary electrical receptacle where the face plate of the electrical receptacle has been removed. The base boxes are covered by the left sliding block 1, the right sliding block 2, the small sliding block 6, and elastic components 4, 4A and 4B. Shown in this Figure is a condition when the safety shield is in an open position, as indicated by the compressed positions of the elastic components 4, 4A and 4B. Under this condition, the gripping wing pieces 321, 331 are exposed due to the opening of the safety shield.

As shown in FIGS. 4 and 5, prior to the insertion of the plug blades, the elastic components 4, 4A, and 4B are in a relax form (FIG. 4). When the plug blades are inserted into the plug blade slots, elastic components 4, 4A and 4B are compressed (FIG. 5), so as to move left sliding block 1, right sliding block 2 and the small sliding block 6. After the plug blades are taken out of the electrical receptacle, left sliding block 1, right sliding block 2 and small sliding block 6 restore to their initial state due to the rebound of elastic components 4, 4A and 4B. At this time, right sliding block 2 and small sliding block 6 are locked together automatically by auto-lock 2G to allow the safety shield to cover the I-shape hole 3D and the T-shape hole 3E on base box 3.

The left sliding block, the right sliding block, the small sliding block of the present invention are made of insulating materials.

FIGS. 3-5 demonstrate the steps of installing the safety shield in an electrical receptacles. As shown in FIG. 3, base box 3 is placed on top of mid-section support frame 35 of the electrical receptacle so that the I-shape hole 3D and the T-shape 3E on base box 3 are in the corresponding positions of the plug blade slots 361, 362 of the face plate 36; and the gripping wing pieces 321, 331 on the power output conductor 32, 33 are positioned underneath the I-shape hole 3D and the T-shape 3E on base box 3, and correspond to the plug blade slots 361, 362 of the face plate 36. Also as shown in FIG. 1, bottom composite, the position post 11 at the bottom of base box 3 is set in the slot 34 of the mid-section support frame 35.

FIG. 4 demonstrates the interrelationship between left sliding block 1, right sliding block 2, small sliding block 6, and elastic components 4, 4A, 4B, in base box 3. As shown in FIG. 4, when no power plug is inserted into the electrical receptacle, left sliding block 1, right sliding block 2, and small sliding block 6, together with their respective slope 5A, 5, 31, form a safety shield which covers the I-shape hole 3D and the T-shape hole 3E on the base box 3, and the gripping wing pieces 321, 331, underneath base box 3. Under this condition, plug blade slots 361, 362 are completely covered. No one can see or touch the exposed gripping wing pieces 321, 331 within the plug blade slots. Even if a child or an adult touches the face plate of the electrical receptacle or inserts a metal object into the plug blade slot carelessly, the safety shield prevents the child or adult from electric shock which causes body and/or property damage.

As shown in FIG. 5, when the plug blades of the power plug is forcibly inserted into the plug blade slots 361, 362 on the face plate 36 of the electrical receptacle, the auto-lock 2G located between right sliding block 2 and the small sliding block 6 is unlocked, which allows left sliding block 1, right sliding block 2 and small sliding block 6 to glide along the surface of base box 3. In the process of gliding, the I-shape hole 3D and T-shape hole 3E on the base box are exposed, so that the gripping wing pieces 321, 331 of the hot output conductor 32 and neutral output conductor 33 can mate with the plug blades to transport power to the power plug.

When the plug blades are retrieved out of the plug blade slots, the safety shield is restored to the original position and the auto-lock is locked due to the rebound of the elastic components 4, 4A, 4B, so as to cover the holes on the base box 3, and provide safety protection to the electrical receptacle. At this time, even if a child or an adult touches the face plate 36 of the electrical receptacle or inserts a metal object into the plug blade slot, he/she would not be exposed to electric shock and damage.

In sum, the advantage of the present invention is that when no plug blades is inserted into the electrical receptacle, the safety shield is self-locked to prevent an exposure of the output conductors to someone who may accidentally injury himself/herself due to electric shock.

While the invention has been described by way of examples and in terms of the preferred embodiments, it is to be understood that the invention is not limited to the disclosed embodiments. On the contrary, it is intended to cover various modifications as would be apparent to those skilled in the art. Therefore, the scope of the appended claims should be accorded the broadest interpretation so as to encompass all such modifications.

What is claimed is:

1. A safety shield in an electrical receptacle; said electrical receptacle having a face plate containing at least two plug blade slots to receive corresponding plug blades;

said safety shield comprising:

a base box having at least two holes corresponding to said at least two plug blade slots on said face plate of said electrical receptacle; said base box containing a left sliding block;

a right sliding block;

a small sliding block; and elastic components;

wherein said left sliding block and said right sliding block are crisscrossed from each other on said base box;

wherein said small sliding block connected to said right sliding block on said base box; and wherein said elastic components are placed between said left sliding block and said right sliding block, and between said small sliding block and a side wall of said base box;

whereby if said corresponding plug blades are not inserted into said plug blade slots of said electrical receptacle, said left sliding block, said right sliding block, and said small sliding block form said safety shield to cover said plug blade slots; if said corresponding plug blades are inserted into said plug blade slots of said electrical receptacle, said elastic components are compressed to allow said left sliding block, said right sliding block, and said small sliding block to open said safety shield, thereby exposing said plug blade slots.

2. The safety shield according to claim 1, wherein said at least two plug blade slots comprises an I-shape plug blade slot and a T-shape plug blade slot; and wherein said base box has an I-shape hole corresponding to said I-shape plug blade slot and a T-shape hole corresponding to said T-shape plug blade slot.

3. The safety shield according to claim 1, wherein said at least two plug blade slots comprises two I-shape plug blade slots; and wherein said base box has two I-shape holes corresponding to said two I-shape plug blade slots.

4. The safety shield according to claim 1, wherein said left sliding block, said right sliding block, and said small sliding block are structured differently.

5. The safety shield according to claim 2, wherein said small sliding block has a longitudinal part which is positioned under one end of said right sliding block on top of said T-shape hole of said base box, and a transverse side wall which is positioned outside of said right sliding block.

6. The safety shield according to claim 1, further comprising an auto-lock to prevent said safety shield from opening when said corresponding plug blades are not inserted into said at least two plug blade slots.

7. The safety shield according to claim 6, wherein said auto-lock is set in said right sliding block and positioned in a groove on said small sliding block; whereby when said corresponding plug blades are inserted into said at least two plug blade slots, said auto-lock is unlocked.

8. The safety shield according to claim 1, wherein said elastic components comprise a first spring positioned between said side wall of said base box and an outer transverse side of said small sliding block; and a pair of second springs positioned between an inner wall of said left sliding block and an inner wall of said right sliding block.

9. The safety shield according to claim 8, wherein said first spring is secured by a first positional block on said base box; and said second pair of springs are secured by a second positional block having a zigzag shape on said base box.

10. The safety shield according to claim 1, wherein a bottom of said small sliding block is extended outwards to be aligned with said safety shield formed by said right sliding block.

11. The safety shield according to claim 1, wherein said transverse side of said small sliding block has a groove corresponding to a protrusion on a side wall of said right sliding block; thereby when said groove on said small sliding block matches with said protrusion on said right sliding block, said small sliding block is positioned beneath said right sliding block and said right sliding block is positioned at an inner side of said transverse side of said small sliding block.

12. The safety shield according to claim 9, wherein said second pair of springs is positioned in a center of said base box between an inner side of said left sliding block and an inner side of said right sliding block.

13. The safety shield according to claim 9, wherein said second pair of springs is parallel to and misaligned with each other.

14. The safety shield according to claim 1, wherein said elastic components are coil springs or leaf springs.

15. The safety shield according to claim 13, wherein when said corresponding plug blades are inserted into said at least two plug blade slots on said electrical receptacle, said second pair of springs is simultaneously compressed toward each other so as to move said left sliding block outward toward left and said right sliding block outward toward right to expose said at least two holes corresponding to said at least two plug blade slots on said base box.

16. The safety shield according to claim 1, wherein said electrical receptacle is a power adaptor, a power cord, an outlet, or a ground fault circuit interrupter.

17. An electrical receptacle comprising:

a housing comprising a face plate containing at least two plug blade slots to receive at least two corresponding plug blades;

a plurality of electrical contacts disposed in said housing; one end of said plurality of electrical contacts being coupled to a power input source and the other end of said plurality of electrical contacts being exposed to said at least two plug blade slots capable of mating with said at least two corresponding plug blades;

a safety shield positioned underneath said at least two plug blade slots to cover said at least two plug blade slots when said at least two corresponding plug blades are not inserted into said at least two plug blade slots; wherein said safety shield comprises:

a base box having at least two holes corresponding to said at least two plug blade slots of said electrical receptacle; said base box containing a left sliding block;

a right sliding block;

a small sliding block; and elastic components;

wherein said left sliding block and said right sliding block are crisscrossed from each other on said base box;

wherein said small sliding block connected to said right sliding block on said base box; and wherein said elastic components are placed between said left sliding block and said right sliding block, and between said small sliding block and a side wall of said base box;

whereby if said corresponding plug blades are not inserted into said plug blade slots of said electrical receptacle, said left sliding block, said right sliding block, and said small sliding block form said safety shield to cover said plug blade slots; if said at least two corresponding plug blades are inserted into said at least two plug blade slots of said electrical receptacle, said elastic components are compressed to allow said left sliding block, said right sliding block, and said small sliding block to open said safety shield, thereby exposing said plug blade slots.

18. The electrical receptacle according to claim 17, wherein said electrical receptacle is a power adaptor, a power cord, an outlet or a ground fault circuit interrupter.

19. The electrical receptacle according to claim 17, wherein said housing of said electrical receptacle comprises a plurality of base boxes.

20. The electrical receptacle according to claim 17, wherein said elastic components comprises a pair of springs positioned in a center of said base box secured by a positional block on said base box; said pair of springs being parallel to and misaligned with each other; wherein when said at least two corresponding plug blades are inserted into said at least two plug blade slots, said pair of springs is compressed toward each other, so as to push said left sliding block to move to left and said right sliding block to move to right, thereby exposing said at least two holes on said base box corresponding to said at least two plug blade slots on said housing of said electrical receptacle.

* * * * *